United States Patent [19]

Stocks

[11] 4,302,915

[45] Dec. 1, 1981

[54] PARKING GARAGE CONSTRUCTION

[75] Inventor: Gerald R. Stocks, North Ridgeville, Ohio

[73] Assignee: Apcoa, Inc., Cleveland, Ohio

[21] Appl. No.: 34,369

[22] Filed: Apr. 30, 1979

[51] Int. Cl.[3] ..... E01F 9/00

[52] U.S. Cl. ..... 52/175; 52/251; 52/236.3; 52/263; 52/722

[58] Field of Search ..... 52/174, 175, 176, 251, 52/252, 236.3, 236.4, 236.7, 722, 263

[56] References Cited

U.S. PATENT DOCUMENTS

| | | | |
|---|---|---|---|
| 3,708,933 | 1/1973 | Yang | 52/263 X |
| 3,745,731 | 7/1973 | Simpson et al. | 52/252 X |
| 3,762,115 | 10/1973 | McCaul et al. | 52/263 X |

*Primary Examiner*—Price C. Faw, Jr.
*Assistant Examiner*—Carl D. Friedman
*Attorney, Agent, or Firm*—Watts, Hoffmann, Fisher & Heinke Co.

[57] ABSTRACT

A parking garage includes a plurality of closely spaced, vertically extending columns arranged in files to form a regular array. The close column spacing largely eliminates the need for beams, spandrels, safety walls, guardrails, or cables previously used to connect adjacent columns. Two of the files form external garage walls whose columns each include portions which are offset with respect to a vertical column centerline. The offset portions alternate vertically and any given offset portion either projects or is recessed with respect to the offset portions immediately above and below it. Each offset portion faces a corresponding offset portion on an adjacent column so that all of the offset portions create a pattern when viewed from a distance. The appearance thus created eliminates the need for curtain walls or any other facade.

7 Claims, 4 Drawing Figures

PARKING GARAGE CONSTRUCTION

FIELD OF THE INVENTION

The invention relates to parking garages having precast portions and, more particularly, to a parking garage in which the need for horizontally disposed beams and curtain walls largely is eliminated.

BACKGROUND OF THE INVENTION

It is common practice to construct parking garages by use of many precast concrete portions. This permits a considerable portion of the garage to be manufactured at one central location from whence the precast portions can be shipped to the building site and erected with a minimum of time at the site. This technique especially is appropriate for a parking garage because the slabs which form both the ceiling and the floor of adjacent vertical levels are well adapted to being cast in one location and shipped to another. Concrete slabs have been improved to the point where they are strong enough to extend from a center file of columns completely to an outer file of columns ("full-span slabs") so that the number of individual garage components has been decreased.

Parking garages typically are constructed by erecting a plurality of vertically extending columns and interconnecting the columns by horizontally extending beams (or spandrels). Thereafter, rectangular precast slabs are placed atop the beams to interconnect the columns and form the various parking levels.

One of the drawbacks of the foregoing construction is that a substantial number of components are required to construct a garage. Assuming the conventional practice of providing two files of exterior columns and one file of interior columns, the slabs must extend from each side of the interior file of columns to both exterior files of columns. Because the slabs usually are inclined to provide ramps by which vehicles may ascend and descend, spandrels having an opposite slope must be disposed on either side of the interior file of columns. Accordingly, not only must spandrels extend between adjacent exterior columns to support one end of the slabs, but two spandrels must extend between adjacent interior columns. This requirement increases the number of garage components. Also, because the interior columns must support two spandrels instead of one, the interior columns must be considerably stronger than the exterior columns and this in turn increases the expense of the garage.

Another drawback of conventional parking garage construction is that additional structure is required to prevent cars from being driven over the outermost edge of the slabs. Although curbs can be molded into the slabs or can be provided separately, it still is necessary for adequate safety to extend cables, guardrails, or safety walls between adjacent columns. This approach is unsightly, and to improve the appearance of the external portion of the parking garage, so-called curtain walls or other facades usually are attached to the columns. The curtain walls are expensive and installation is time-consuming.

A parking garage construction is known in which the spandrels extending between interior columns no longer are needed. This is brought about by spacing the columns close together and resting the slabs directly on outwardly projecting portions (haunches) included as part of the columns. Although this construction eliminates the spandrels extending between interior columns and thus provides a garage having fewer components and lighter-weight interior columns, it still fails to solve other prior art concerns such as the need for safety walls, guardrails, curtain walls, and so forth.

In general, it is a major concern in constructing a parking garage to construct the garage with the fewest possible components and to precast as many of those components as possible, while at the same time creating an aesthetically pleasing structure. Although certain advances have been made, still additional improvements are possible.

SUMMARY OF THE INVENTION

The present invention provides a new and improved parking garage construction which overcomes the objections mentioned above and which is exceedingly simple, practical, and at the same time aesthetically pleasing. Because of the arrangement of vertically extending columns, the need for horizontally extending beams is eliminated; the appearance created by the columns is such that the need for curtain walls or other facades likewise is almost completely eliminated.

The invention is characterized by a plurality of closely spaced, vertically extending columns arranged in files to form a regular array. The columns forming the external walls of the garage comprise portions offset with respect to the column centerline. The offset portions alternate vertically and any given offset portion either projects or is recessed with respect to the offset portions immediately above and below it. Each offset portion faces a corresponding offset portion on an adjacent column so that all of the offset portions create a pattern when viewed from a distance. The appearance of the pattern is enhanced by the alternate projecting and recessed portions which provide an unusual spatial effect.

The columns also include haunches projecting outwardly and extending toward haunches on columns in files oppositely disposed. Each of the haunches faces a corresponding haunch disposed at about the same vertical level. By this construction, precast slabs may extend between columns oppositely disposed and rest upon the haunches. It is expected that adjacent slabs at their edges will abut to form a largely uninterrupted surface.

Adjacent columns in any given file are spaced close enough that the need for beams or spandrels is obviated. The appearance created by the closely spaced columns having offset portions alternating vertically also completely eliminates the need for curtain walls or any other facade. This construction also largely eliminates the need for safety walls, guardrails, or cables, although it is expected that one or two cables will be employed as a safety measure for pedestrians.

Additional advantageous features of the invention will become apparent from the following detailed description of a preferred embodiment of the invention made with reference to the accompanying drawings which form a part of the specification.

DESCRIPTION OF THE PREFERRED EMBODIMENT

Figure 1:
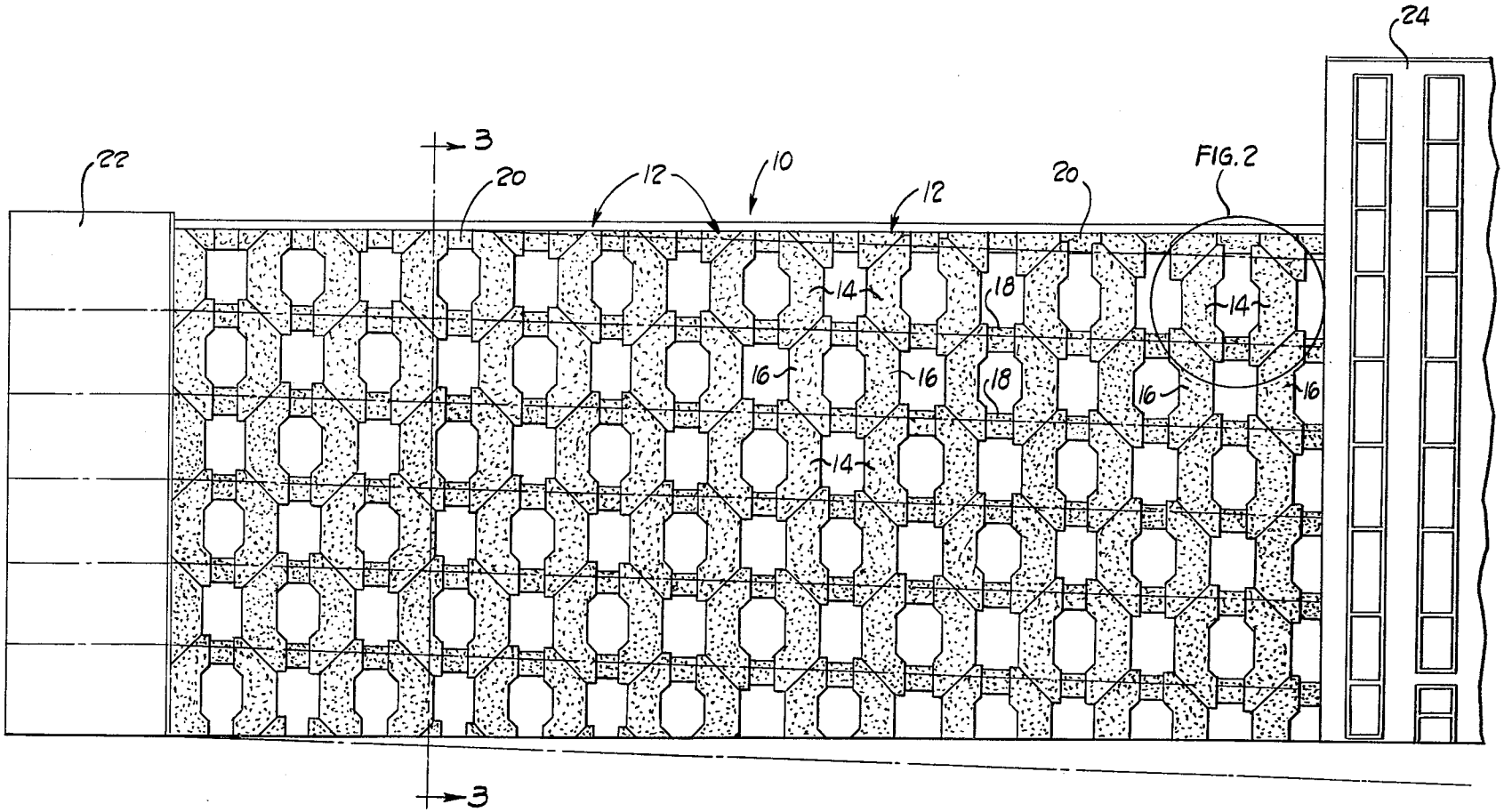
FIG. 1 is a side elevational view of a parking garage according to the invention showing about half the length of the garage.
Figure 2:
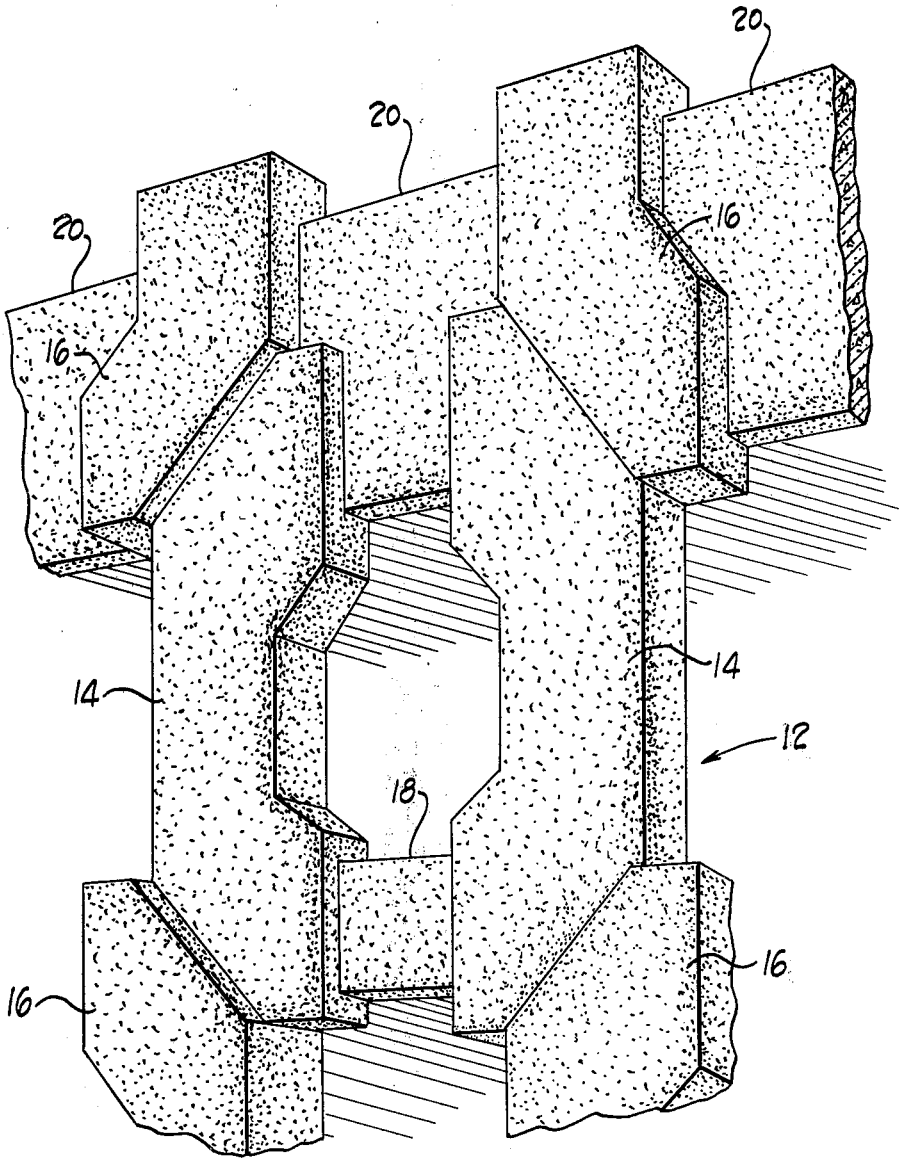
FIG. 2 is an enlarged, perspective view of a portion of FIG. 1 showing the column construction in more detail.

A parking garage 10 according to the invention is shown in FIG. 1. The garage includes a plurality of vertically extending exterior columns 12, each having first offset portions 14 and second offset portions 16 symmetrically disposed on either side of the column centerline. This construction is shown in more detail in FIG. 2. It is expected that each column will be precast at a central location and shipped to the job site for erection. Because there are only two basic types of column construction (any given offset portion faces either one way or the other), only two molds are required and this minimizes construction costs.

Precast infills 18 are fitted between the offset portions to connect adjacent columns at each vertical level. The infills do not perform a structural function, although they contribute to the aesthetic quality of the garage by tying together the pattern created by the columns. An exception is the uppermost infill (indicated in the drawings at 20) which is at roof level and which serves as a retaining wall to prevent pedestrians or vehicles from falling from the roof. The uppermost infill 20 is more substantial and also interconnects the upper ends of the columns to prevent relative motion between the columns.

One end of the garage is covered by facing brick 22 and the center of the garage, including elevator shafts and stairs, likewise is covered by facing brick. This is indicated in FIG. 1 at 24.

Figure 3:
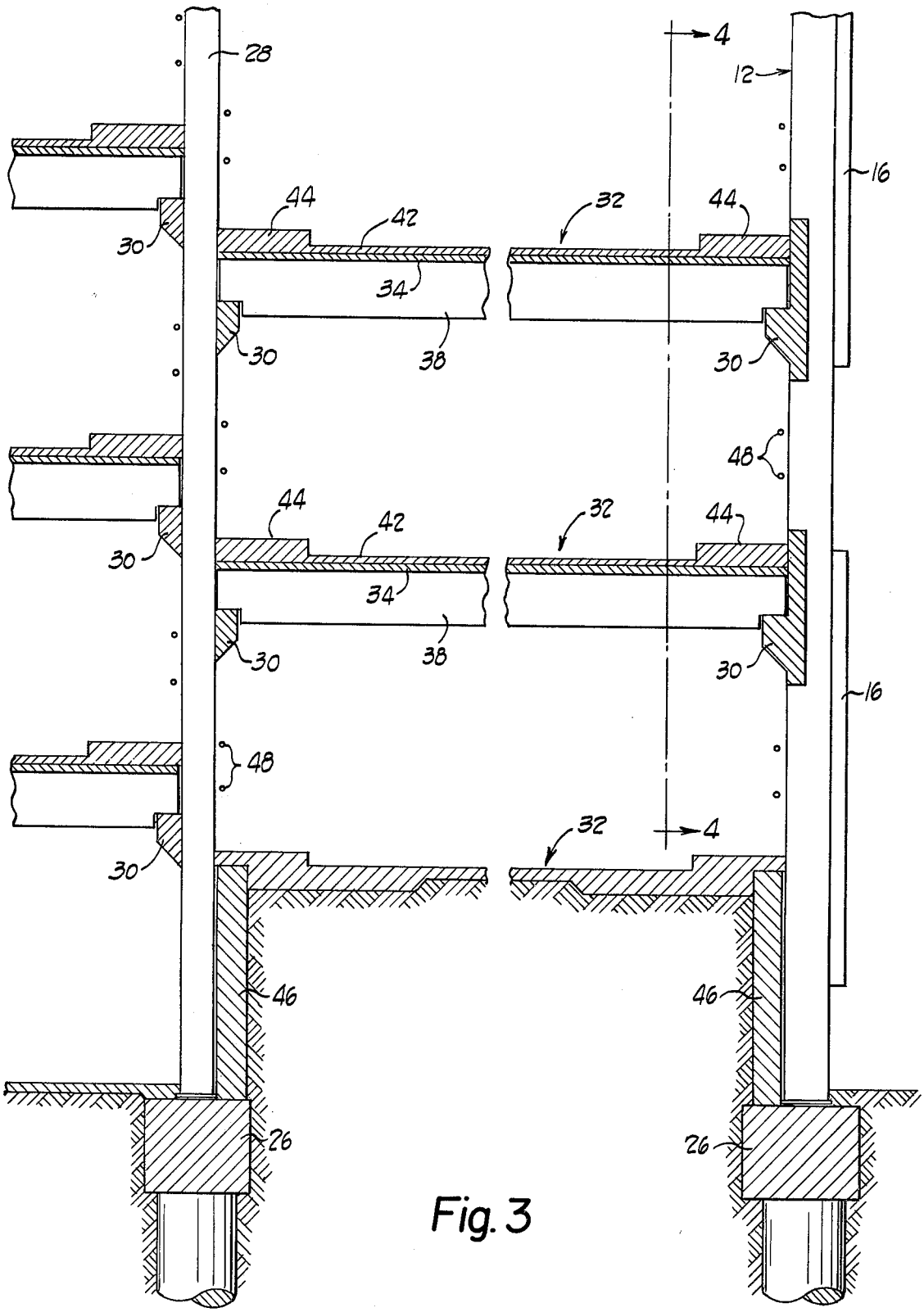
FIG. 3 is a view taken along line 3—3 of FIG. 1 showing the slabs and columns in cross-section.

Referring to FIG. 3, each exterior column rests upon a caisson 26 securely anchored in the ground. A file of interior columns 28 also is provided and each of these columns also rests on a caisson. An interior column 28 is provided for every exterior column 12. In the typical application, it is expected that there will be two files of exterior columns and one file of interior columns, with the number of ranks determined by the number of parking places desired.

Figure 4:
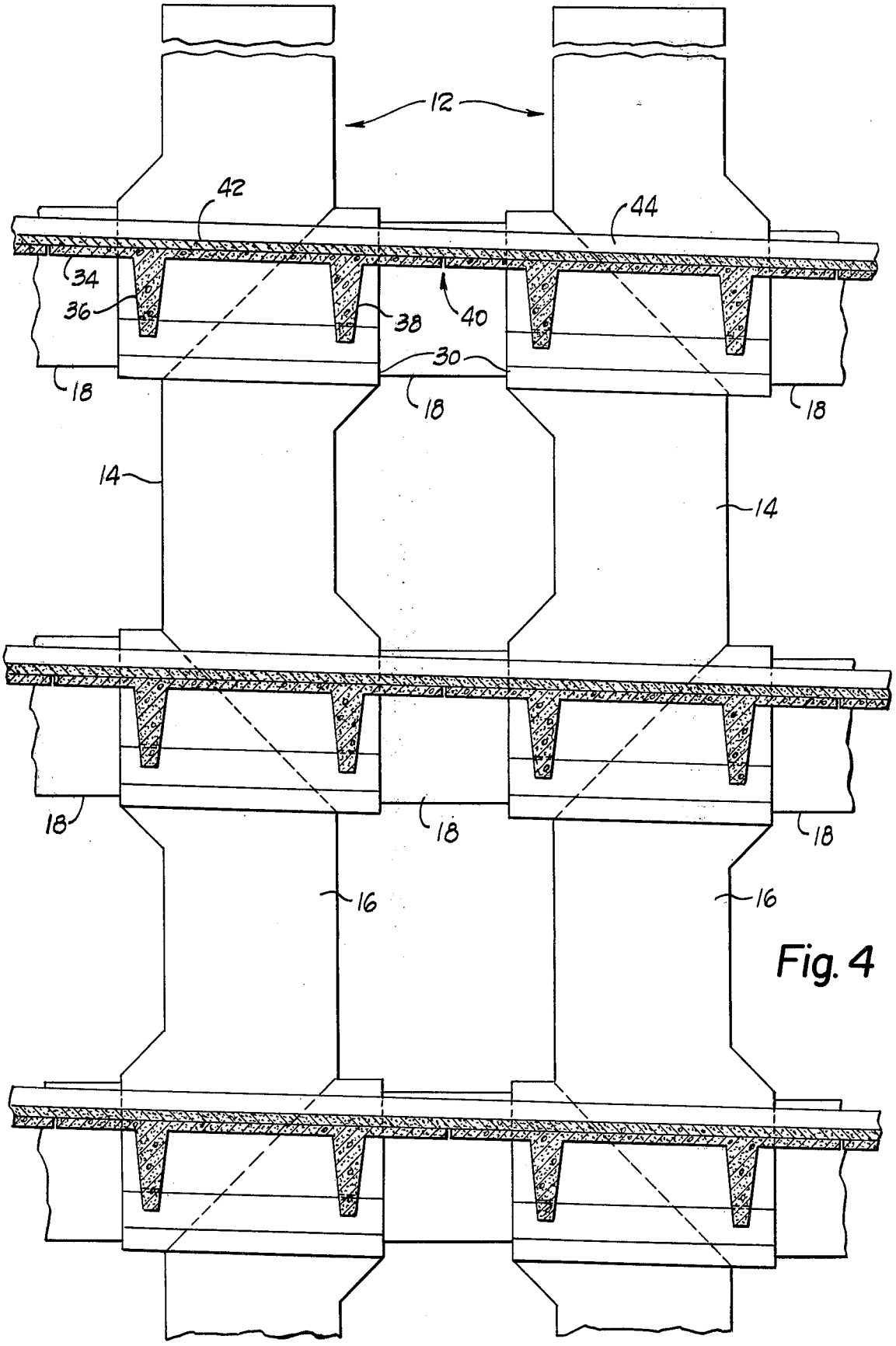
FIG. 4 is a view taken along line 4—4 of FIG. 3 showing an interior view of the columns and the relationship between adjacent slabs and adjacent columns.

A plurality of generally horizontally extending haunches 30 project from each column 12, 28 and face toward columns in files oppositely disposed. Full span slabs 32 rest atop haunches disposed at about the same vertical level and extend completely from an interior column to the corresponding exterior column. Referring to FIG. 4, the slabs are so-called double-T slabs having a planar upper surface 34 and depending legs 36, 38 spaced inwardly from the edges of the planar upper surface.

The legs 36, 38 rest atop a haunch 30 so that each column 12, 28 carries one end of a slab 32. Alternatively, because of the close spacing of the columns, it would be possible for a slab to span two adjacent columns so that a leg 36 would rest on one haunch and the other leg 38 would rest on another haunch. Regardless of which approach is taken, the upper surface 34 of each slab abuts or nearly abuts the upper surface 34 of adjacent slabs as at 40 to present a largely uninterrupted surface.

In order to provide an inclined upper surface, the haunches 30 are disposed at about a 3% slope as viewed in FIGS. 1 and 4. The same result could be accomplished by disposing the haunches 30 precisely horizontally and making one leg 36, 38 shorter or longer than the other. This construction is not carried through at the ends and middle of the garage; at those places, the slabs are disposed horizontally to permit drivers to cross from one side of the garage to the other. Stated differently, drivers can cross from an incline located between two files of columns to an incline having an opposite slope located between another two files of columns. Accordingly, the haunches on the columns at the ends and middle of the garage are disposed horizontally.

A topping 42 is poured in place on top of the slabs after the slabs have been placed atop the haunches. The topping includes a stepped portion 44 along that edge of the slab adjoining the columns. Both the topping and the stepped portion extend the length of the garage to provide a smooth surface and gutter which will convey water to drains (not shown). The stepped portions also act as curbs to assist operators of vehicles in parking the vehicles.

At ground level, precast beams 46 extend the length of the garage to act as a retaining wall. The upper surface of the beams 46 also acts as a haunch to support the lowermost level of slabs.

Cables 48 extend from one end of the garage to the other and connect the columns. The cables principally serve to prevent pedestrians from falling from the upper levels of the garage between the columns. Because the cables are not needed to prevent vehicles from being driven over the edge of the slabs, the cables can be made much lighter or fewer in number than those used in prior garages.

The foregoing arrangement of components conserves a substantial expense in constructing a parking garage, principally by requiring fewer garage components through the elimination of spandrels and curtain walls. Although more columns are needed than in prior garages, the need for spandrels is eliminated completely and this results in a great savings of material and components. By way of example, column centerlines in prior garages have been spaced approximately 27 feet (with spandrels bridging that gap) and three slabs, nine feet wide, resting atop each spandrel. Assuming three files of columns and looking at any two adjacent ranks of columns, four spandrels are required—one between the exterior columns on each side of the garage and two connecting the interior columns. In a six-story garage, then, 24 spandrels are required.

Even though the garage according to the present invention would require a column to support the end of each slab, that is, nine columns instead of six would be required in the example given, the elimination of the need for spandrels more than makes up for this increase in the number of columns. Furthermore, the close spacing of the columns largely does away with protective rails or cables, as well as various facades.

Although the invention has been described with a certain degree of particularly, it will be appreciated that the present disclosure of the preferred embodiment has been made only by way of example. Various changes in the details of construction may be resorted to without departing from the true spirit and scope of the invention and it is intended to cover all such changes in the appended claims.

I claim:

1. A parking garage having precast portions and characterized by a substantial lack of horizontally extending beams, the garage comprising:

(a) a plurality of vertically extending columns, the columns arranged in files and those columns forming the external walls of the building comprising:

(i) first portions laterally offset with respect to the column centerline;

(ii) second portions laterally offset with respect to the column centerline, the offset portions alternating vertically and any given offset portion being either projected or recessed with respect to the offset portions immediately above and below it; and (iii) haunches projecting outwardly of the columns, the haunches extending toward haunches of columns in files oppositely disposed, each haunch facing a corresponding haunch disposed at about the same vertical level; and (b) slabs extending between columns oppositely disposed and resting on haunches, adjacent slabs along their sides being substantially abutted to form a largely uninterrupted surface.

2. The garage of claim 1, wherein each offset portion faces a corresponding offset portion on an adjacent column.

3. The garage of claim 2, wherein infills extend between and connect facing offset portions.

4. A column to form the exterior wall of a parking garage, comprising:

(a) a vertically extending central portion;

(b) portions projecting laterally outwardly of the central portion and alternating vertically in a zig-zag pattern; and (c) each projecting portion either is recessed or relieved with respect to adjacent projecting portions.

5. A parking garage having precast portions and characterized by a substantial lack of horizontally extending beams and facades, the garage comprising:

(a) a plurality of vertically extending columns, the columns arranged in three files and forming a plurality of ranks to provide parking spaces along any given file, the columns defining end ranks and a middle rank disposed about halfway between the end ranks, each column comprising:

(i) haunches projecting outwardly of the column, the outermost files having haunches facing the middle file and the middle file having haunches facing both of the outermost files, each haunch facing a corresponding haunch disposed at about the same vertical level;

(ii) first portions laterally offset with respect to the column centerline of those columns comprising the outermost files, the laterally projecting portions when viewed from above spaced about 90° from the haunches; and (iii) second portions laterally offset with respect to the column centerline, the first and second portions alternating vertically and any given offset portion being either projected or recessed with respect to the offset portions immediately above and below it; and (b) a slab spanning the columns forming each rank and resting atop the haunches, the longitudinally extending sides of each slab being substantially abutted with the longitudinally extending side of the adjacent slabs to form a largely uninterrupted surface, the slabs being inclined to the horizontal to form inclines connecting the end and middle ranks, and the slabs spanning the space between files of columns at the end and middle ranks being disposed substantially horizontally.

6. A column to form the exterior wall of a parking garage, comprising:

(a) a vertically extending central portion;

(b) portions projecting laterally outwardly of the central portion and alternating vertically in a zig-zag pattern;

(c) each of the columns having outwardly projecting haunches, the haunches being spaced vertically along the column and, when viewed from above, spaced about 90° from the laterally projecting portions.

7. A parking garage having precast portions and characterized by a substantial lack of horizontally extending beams and facades, the garage comprising:

(a) a plurality of vertically extending columns, the columns arranged in at least three files and forming a plurality of ranks to provide parking spaces along any given file, each column comprising:

(i) haunches projecting outwardly of the column, the outermost files having haunches facing the middle file and the middle file having haunches facing both of the outermost files; and (ii) portions projecting laterally outwardly of the central portion of those columns comprising the outermost files, the laterally projecting portions when viewed from above spaced about 90° from the haunches; and (b) a slab spanning the columns forming each rank and resting atop the haunches, each slab having longitudinally extending sides substantially abutted with the longitudinally extending sides of the adjacent slabs; and (c) said laterally projecting portions including:

(i) first portions offset with respect to the column centerline; and (ii) second portions offset with respect to the column centerline, the offset portions alternating vertically and any given offset portion being either projected or recessed with respect to the offset portions immediately above and below it.

* * * * *